United States Patent [19]

Grimsley et al.

[11] Patent Number: 4,871,423

[45] Date of Patent: Oct. 3, 1989

[54] ENHANCED DITHIONITE BLEACHING

[75] Inventors: S. Allen Grimsley, Portsmouth; James C. Robinson, Chesapeake; Mark A. Schroeder, Norfolk, all of Va.

[73] Assignee: Hoechst Celanese Corporation, Somerville, N.J.

[21] Appl. No.: 83,202

[22] Filed: Aug. 10, 1987

[51] Int. Cl.[4] ..... D21C 9/12

[52] U.S. Cl. ..... 162/72; 162/75; 162/76; 162/160

[58] Field of Search ..... 162/72, 75, 76, 160; 422/8

[56] References Cited

U.S. PATENT DOCUMENTS

| | | | |
|---|---|---|---|
| 2,070,585 | 2/1937 | Dreyfus | 162/76 X |
| 4,238,282 | 12/1980 | Hyde | 162/76 |
| 4,504,576 | 3/1985 | Kemme | 162/158 X |

*Primary Examiner*—David L. Lacey
*Assistant Examiner*—Thi Dang
*Attorney, Agent, or Firm*—Depaoli & O'Brien

[57] ABSTRACT

Compositions and a method are disclosed for minimizing brightness reversion of chromophore-containing wood pulps, especially low-cellulose wood pulps, such as groundwood and thermomechanical pulps, which have been reductively bleached or bleached with hydrogen peroxide. Ascorbic acid and palmitoyl ascorbate are particularly effective for preventing such reversion at low levels.

10 Claims, 1 Drawing Sheet

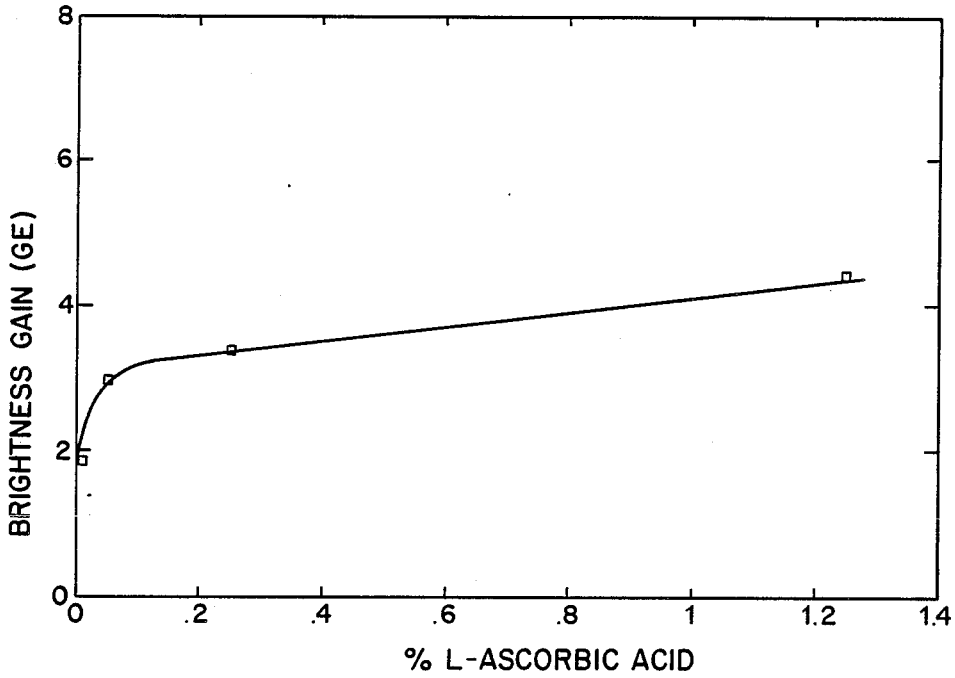
BRIGHTNESS GAIN (GE)
0
2
4
6
8
0
.2
.4
.6
.8
1
1.2
1.4
% L-ASCORBIC ACID

ENHANCED DITHIONITE BLEACHING

BACKGROUND OF THE INVENTION

1. Field of the Invention

This invention relates to minimizing brightness reversion of wood pulps bleached with certain bleaching agents and especially relates to minimizing such reversion of relatively impure wood pulps such as mechanical pulps used for newsprint and magazines.

2. Review of the Prior Art

Wood pulps can be classified as chemical pulps and low-cellulose pulps. Chemical pulps are prepared by pulping methods involving chemical removal of much of the non-cellulosic wood materials, such as lignins, hemicelluloses, and other impurities, to leave a relatively purified pulp composed of 80–100% cellulose. These pulping methods involve chemical digestion and are typified by kraft, sulfite, and like methods.

The low-cellulose wood pulps are prepared by mechanical and chemi-mechanical methods which leave the bulk of the non-cellulosic constituents of the wood in the pulp because separation of the wood material into fibers operates primarily through mechanical attrition of the wood, either in the form of chips or as logs, so that the bulk of the non-cellulosic constituents thereof remain in the fibers. Such fibers contain up to about 60% cellulose, with the remaining elements in the pulp being on the order of 40–60% non-cellulosic wood materials.

The strictly mechanical methods for producing low-cellulose wood pulps are represented by the groundwood process, in which logs or other large pieces of wood are ground on a grinding stone, and by various refining processes in which the wood chips are mechanically subdivided within disc or similar refiners. Chemi-mechanical methods involve softening of the wood with aqueous softening agents, such as sulfites, bisulfites, and the like, without substantial extraction of non-cellulosics before the wood is mechanically subdivided into fibers.

The low-cellulose wood pulps are particularly desired because of their low cost and generally satisfactory physical properties. Their preparation involves very little loss of the original wood, and methods of producing them are generally less expensive than methods involving strong chemical attack. The particular utility of these pulps is in the preparation of printing papers, newsprint, molded products, corrugated paper, boxboards, and the like.

While it is economically favorable to retain the bulk of the wood materials in mechanical pulps, it causes the pulps to have a relatively dark color and makes it difficult to bleach them.

Wood is a very complex and irregular macromolecular system made of carbohydrates and phenylpropane units as the two main components. The former are primarily celluloses but include various amounts of hemicelluloses, and the latter are generally identified as lignin. Within these essentially colorless materials, there are relatively small amounts of chromophoric groups in the lignin which cause the yellow-brown color of wood. The basic chromophoric structures which have been identified are of three main types: (a) ortho- and para-quinones, (b) ortho-hydroxy- and para-hydroxyphenyl ketones, and (c) para-quinone methides.

When a mechanical pulp is bleached with certain bleaching processes, such as the chlorine process, these chromophores are absolutely destroyed and yield is markedly reduced. Chlorine "bleaching" is actually a lignin-destructive process that is consequently used only on high-cellulose pulps, such as kraft pulp; it produces lignin byproducts which are subsequently removed by alkaline extraction.

Other bleaching processes, however, such as reductive bleaching processes and the peroxide process, result in retention of substantial amounts of potential chromophores. Reductive bleaching methods, which are less expensive than oxidative bleaching methods, are generally used for low-cellulose pulps, employing dithionites, borohydrides, thiourea dioxide, and the like. Oxidative bleaching with hydrogen peroxide generally produces higher brightness than reductive bleaching but is more expensive.

Mechanically-disintegrated wood pulp, commonly referred to as groundwood pulp, is usually bleached with a reductive agent. For example, at least 0.25% by weight of sodium dithionite is used, based on the weight of the dry pulp, and preferably 0.5% to 1.5% on the same basis. Other compounds, such as sodium tripolyphosphate, disodium phosphate, and the like, are also generally added to improve the bleaching process. Trisodium nitrilotriacetate (NTA) and trisodium ethylenediamine-tetraacetate (EDTA) are also widely employed to chelate the metal ions.

Varied ions in a groundwood bleach system are suspected of causing major problems which seriously affect the brightness gain in a given pulp bleaching operation. First, the groundwood pulp acts as a low-capacity cation exchanger with a great affinity for metals, such as iron, which, in turn, produce colored compounds in the pulp. Second, during storage of the bleached pulp, a brightness reversion, which requires an increased quantity of the bleaching agent to be used initially, is likely to develop. Third, metal ions in the bleaching system may catalyze the decomposition of sodium dithionite, which causes further increased consumption thereof to obtain a given pulp brightness.

Brightness is one of the most important product specifications in making paper. There is increasing pressure on paper manufacturers to improve brightness of their products, even though the raw material brightness may be lower for their groundwood pulps. These pressures have pushed dithionite bleaching technology to its limits. Consequently, many paper manufacturers are considering switching to the more expensive oxidative bleaching processes in order to meet the increasing brightness demand.

Even with the best bleaching methods, however, bleached pulps tend to revert toward their original dark color on standing, particularly when in wet pulp form, and overcoming such color reversion is a major objective of the pulp and paper industry.

Brightness increases for groundwood pulps, when bleached with dithionite, occur through the reduction of certain chromophores to lower their absorption in the visible portion of the electromagnetic spectrum. Measurement of the brightness change by such a treatment, relative to a magnesium oxide or a barium sulfate standard, shows that less than 1% sodium dithionite applied to the pulp can yield a change of 12–16 percentage points of brightness. In practice, this is never achieved because a reduction of the chromophores and the consequent color removal are not permanent. Oxidative reversion of these sites occurs especially while the pulp is wet and exposed to air, and only 8–10 points of brightness gain can be retained.

It has previously been noted that ascorbic acid can be used as a bleaching agent and also as a uv-light screen. In these capacities, ascorbic acid increases brightness through reduction of chromophores or by itself undergoing light-induced decomposition instead of chromophores in the pulp.

A study reported in the *Pulp and Paper Magazine of Canada,* 65 T459-T466(1964), involved treating samples of filter paper with solutions of model compounds and then heating the treated paper at various temperatures and for various time periods in a circulating oven. Of the 34 model compounds tested, glucoronic acid gave the most reversion on oven aging at 105° C. and ascorbic acid and triose uronic acid were the worst at 75° C.

Wood veneers treated with aqueous solutions of ascorbic acid or its mixture with NaCl have improved resistance to discoloration by light, as reported in *Jpn. Kokai Tokkyo Koho,* JP 57,159,604.

U.S. Pat. No. 3,829,358 discloses the addition of a diglycolate and particularly the alkali metal salts of diglycolic acid, which are nitrogen and phosphorus-free, as adequate chelating agents for groundwood pulp bleaching with sodium dithionite. It particularly teaches that disodium diglycolate has a calcium sequestering power which is stronger than sodium citrate on a weight basis and a weaker power than either EDTA or NTA.

Thiourea is employed to minimize color reversion in reductive bleaching processes, as taught in U.S. Pat. No. 3,507,743, for pulps from a wide variety of wood sources while using dithionites, borohydrides, thiourea dioxide, and the like.

U.S. Pat. No. 4,238,282 discloses a method for increasing the final brightness of pulp contaminated with iron or manganese during a chlorine bleaching process having one or more alkaline stages. The process particularly comprises treating the pulp with at least 0.1 pound per ton of a water-soluble chelating agent by adding it under acidic conditions, after the last alkaline stage has extracted almost all of the oxidized lignin, to prevent iron and manganese from interfering with the final brightness of the pulp after this oxidative bleaching is completed. After such chlorine treatment, substantially no chromophores remain; the only source of color is metal ion contamination. Ascorbic acid, tartaric acid, and gluconic acid are among the chelating compositions that were evaluated. When added to the D-stage make-up water at a level of 4 pounds/ton of the neat product, the brightness preservation for ascorbic acid was 75.0%.

SUMMARY OF THE INVENTION

Accordingly, it is an object of this invention to provide a composition which is a useful bleaching antioxidant.

It is also an object of this invention to provide a method for counteracting the brightness reversion of a low-cellulose pulp which has been reductively bleached or bleached with hydrogen peroxide, whereby some of the chromophores remain.

In accordance with these objects and the principles of this invention, a composition and a method for use thereof in minimizing brightness reversion of bleached chromophore-containing low-cellulose pulps and particularly bleached chromophore-containing groundwood pulps are herein provided. The preferred composition comprises furanones and particularly ascorbic acid and derivatives thereof, such as 6-0-palmitoyl L-ascorbic acid (PA) or 6-0-octanoyl-L-ascorbic acid. The method of use thereof is to add antioxidant to the bleach reactor or to spray the antioxidant onto the bleached pulp after a sheet is made and before drying thereof. The antioxidant may be in the form of a dry powder, an aqueous solution, or a non-aqueous solution, such as a methanolic solution.

Nonwater-soluble antioxidants may be applied before, during or after bleaching. Water-soluble antioxidants must be applied after substantial dewatering is carried out.

It has surprisingly been discovered that pulp bleached with aqueous sodium dithionite blends or with hydrogen peroxide, in the presence of an antioxidant selected from the group consisting of ascorbic acid and palmitoyl ascorbate, is brighter than pulp bleached with dithionite blends only or peroxide only.

This discovery was made while testing the following compounds in Table 1 which were added as solutions, before or after handsheet preparation, to several wood pulps bleached with sodium dithionite blends. Of these 28 compounds, only ascorbic acid and palmitoyl ascorbate were effective for producing brighter pulps than pulps bleached with dithionite blends only. Subsequent testing established that a wide variety of antioxidant compositions comprising furanones were effective.

TABLE 1

| Tested Antioxidants and Synergists | |
|---|---|
| Ascorbic Acid (AA) | Sodium Benzoate |
| Sodium Diethyldithiocarbamate | Dihydroxylmaleic Acid |
| Sodium Metabisulfite | ν-Butyrolactone |
| Butylated Hydroxyanisole | 3,4-Dihydroxybenzoic Acid |
| Butylated Hydroxytoluene | 2,3-Dihydroxybenzoic Acid |
| Hypophosphorus Acid | 3,4-Dihydroxy-3-Cyclobutene-1, 2-dione |
| Sorbic Acid | 2-Butene-1,4-diol |
| Thymol | Resorcinol |
| Hydroquinone | 1,2,4-Benzenetriol |
| Citric Acid | β-Carotene |
| EDTA | 1-Allyl-2-thiourea |
| Sodium Dithionite | Glutathione |
| n-Propyl Gallate | α-Tocopherol |
| Catechol | 6-O—Palmitoyl-L-Ascorbic Acid (PA) |

With ascorbic acid or palmitoyl ascorbate applied to the bleached pulp at less than 5% by weight, increases of 10–60% in retained brightness over the normal 8–10 point gain are achieved. At these treatment levels, the increased response is due to increased retention of brightness gains achieved with sodium dithionite, not to any bleaching contribution from the antioxidant, because the antioxidant at these levels has no bleaching capacity, thus indicating that the brightness increases are a result of protecting chromophores, which have been reduced by dithionite or oxidized by hydrogen peroxide, from reversion. These compounds may also protect the chromophores not bleached by dithionite but subject to reversion. For example, the antioxidants can be effectively added to the pulp before it is bleached, thereby indicating that chromophores untouched by bleaching agent may additionally be protected.

The antioxidant composition of this invention is useful for a reductive bleaching process or a peroxide oxidative bleaching process, such as processes utilizing dithionites for bleaching wood pulps and particularly for processes using sodium dithionite, especially when the pulp is a low-cellulose wood pulp, such as groundwood or thermomechanical pulp (TMP). This antioxidant composition comprises furanones having the formula, 3,4-dihydroxy-2(5H)-furanone, and the following structural formula:

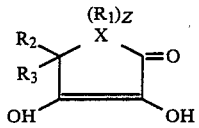

wherein X is O, S, N, Si, C; Z is a whole number from 0–2 and $R_1$ is hydrogen or an alkyl having 1–5 carbon atoms.

The specific nature of $R_2$ and/or $R_3$ is not narrowly critical and can be any substituent providing it does not attack the furanone ring.

Examples of $R_2$ and $R_3$ include alkyl (including substituted alkyl), aryl, acyl, alkoxy, amino, and quaternary ammonium.

Preferred compositions are those wherein X is oxygen. Obviously, when X is oxygen, Z is zero.

Representative compounds that are encompassed by formula (1) include:

(A)
X=0
Z=zero
$R_3$=H
$R_2$=

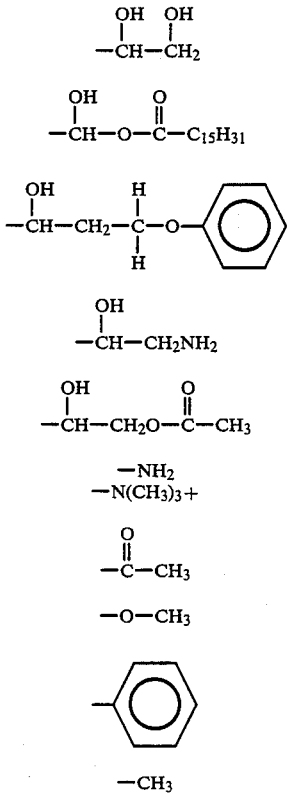

(B)
X=S
Z=0
$R_3$=H
and $R_2$ is the same as in (A)

(C)
X=C
Z=2
$R_1$=H
$R_3$=H
and $R_2$ is the same as in (A)

(D)
X=Si
Z=2
$R_1$=H
$R_3$=H
and $R_2$ is the same as in (A)

(E)
X=N
Z=1
$R_1$=H
$R_3$=H
and $R_2$ is the same as in (A)

Particularly preferred compounds are ascorbic acid and palmitoyl ascorbate (PA).

Palmitoyl ascorbate (PA) has the following formula:

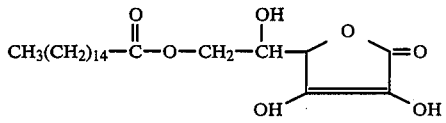

A preferred embodiment of this invention resides in treating the reductively-bleached wood pulps after treatment with the furanones. It has been found that drying of the bleached, furanone-treated pulp in the absence of oxygen enhances the retention of brightness gain. Such drying is particularly effective for brightness retention in the absence of oxygen, such as in an inert gas or in a vacuum, but it does work with lesser effectiveness in the presence of oxygen, such as in air.

These furanones comprise ascorbic acid and its derivatives, such as palmitoyl ascorbate. In processes for bleaching groundwood such as newsprint pulp, sodium dithionite is typically added at about 1% by weight of the dry pulp. The furanones may be added to such low-cellulose pulps before, during, or after bleaching thereof with sodium dithionite or can be sprayed onto sheets of the pulp before drying thereof. Such addition is at about 0.01% to about 5.0% by weight of the dry pulp and preferably at 0.5% to about 2.0% by weight of the dry pulp.

With the furanones applied to the bleached pulp as antioxidants at less than 5%, increases of 10–60% in retained brightness over the normal 8–10 point gain are achieved.

Use of ascorbic acid as an antioxidant for both reductively-bleached and peroxide-bleached, low-cellulose pulps imparts retained brightness. The brightness gain can vary from about 1 to about 3 points depending on the amount of ascorbic acid used.

BRIEF DESCRIPTION OF THE DRAWING

The Figure is a graph showing the brightness gain for air-dried handsheets made from reductively bleached thermomechanical pulp, after spraying with solutions of L-ascorbic acid.

EXAMPLES

A laboratory investigation, directed to reductive bleaching of mechanical pulps, which were either groundwood or thermomechanical pulps, furnished comparative brightnesses against a MgO or $BaSO_4$ standard for handsheets dried in air at ambient temperature and in air at 60° C. Methanolic and/or aqueous solutions of numerous antioxidants or synergists with sodium dithionite were then added to the bleach reactor, the furnish, or the handsheets.

Bleaching of the pulps was done at 3.5% consistency and 60° C. for 60 minutes with 1% V-BRITE®, a proprietary compound manufactured and sold by Virginia Chemicals Inc. and comprising sodium dithionite. Handsheets were formed by diluting the 3.5% consistency bleached stock to 0.5% consistency and filtering the slurry in a large fritted glass funnel (coarse porosity) having its frit surface covered with #4 Whatman filter paper. Each handsheet was then pressed in accordance with TAPPI standards and allowed to dry at ambient temperature and humidity for no more than 24 hours.

Adding test solutions to handsheets was done by spraying or by displacement washing. The displacement washing procedure comprised the following steps: (1) estimating the amount of water in the handsheet in a Buchner funnel, (2) dissolving the test antioxidant in that amount of a selected solvent, (3) applying this quantity of test solution to the handsheet, and (4) applying a vacuum to the funnel and drawing the solution into the handsheet to displace the water already in the handsheet. Spraying of a test solution was done directly onto a handsheet in the funnel or onto the handsheet just after removal from the funnel.

Bearing in mind that ascorbic acid had been reported in the literature as being used both as a bleaching agent for unbleached pulp and as a uv-light screen, the antioxidants were applied to unbleached pulp to test for bleaching effects and all tested samples were stored and dried in the dark immediately after preparation thereof to guard against the effects of light. Thus, the brightness increases that were observed cannot be due to the action of ascorbic acid as a bleaching agent or by ascorbic acid interfering with uv-light degradation of bleached pulp chromophores.

EXAMPLES 1–5

A southern pine pulp was made into handsheets which were dried in air. An aqueous solution of 1% V-BRITE B® (a trademark of Virginia Chemicals Inc. for a proprietary bleaching composition comprising $Na_2S_2O_4$) was added to the bleach reactor of Example 1 at a 1% level. The bleached pulp was made into duplicate handsheets having measured brightness values of 60.6 and 61.6, averaging 61.1, as shown in Table 2 as Example 2.

The bleached pulp of Example 2 was made into handsheets which were displacement-washed with methanol (Example 3) and with water (Example 3a). The same bleached pulp was made into a set of handsheets which were displacement-washed with an aqueous solution of 2.5% ascorbic acid. The measured brightness values show that an antioxidant-containing displacement wash of bleached handsheets on the filter helped to retain bleached brightness of paper in air. Spray application and in situ bleach application were also evaluated. The former was quite effective, but the latter produced lower retained brightness than displacement treatment.

The bleached pulp of Examples 3 and 4 was made into another set of handsheets which were displacement-washed with a 5% methanolic solution of ascorbic acid (AA), as Example 5. The air-dried handsheets had a brightness of 65.2 points, as shown in Table 2.

TABLE 2

| Example No. | Handsheet Treatment | Final Brightness | Brightness Gain (relative to air-dried pulp) |
|---|---|---|---|
| 1 | None, unbleached | 53.3 | — |
| 2 | Air-dried (a.d.), bleached (b) | 61.1 | — |
| 3 | Methanol displ.; a.d., b | 63.6 | 2.5 |
| 3a | Water displ.; a.d., b | 61.6 | 0.5 |
| 4 | 2.5% AA*; a.d., b | 64.1 | 3.0 |
| 5 | 5.0% AA**; a.d., b | 65.2 | 4.1 |

*Aqueous solution
**Methanolic solution

These data indicate that bleaching with 1% V-BRITE B® gives a 7.8 point brightness gain in air over unbleached pulp, a typical improvement. Treatment with methanol improved the brightness of the air-dried pulp substantially, probably because water, the presence of which is conducive to rapid reversion, was removed from the handsheets by the methanol wash. The ascorbic acid antioxidant treatment improved brightness by about 50%.

EXAMPLES 6–9

Southern pine pulp was bleached with 1% V-BRITE B® for one hour at 60° C. Handsheets were made and treated by spraying ascorbic acid solution onto the freshly made handsheets, before pressing thereof in accordance with TAPPI standards, to determine: (1) if elevated-temperature drying would affect the brightness of ascorbic-acid treated handsheets and (2) if the shorter drying times would increase bleached pulp brightness relative to air drying. Treatments and brightnesses of the handsheets are indicated in Table 3.

TABLE 3

| Example No. | Handsheet Treatment | Final Brightness | Brightness Gain |
|---|---|---|---|
| 6 | No treatment; air-dried (18 hours) | 63.8 | — |
| 7 | No treatment; oven-dried (60° C., 20 min.) | 64.8 | 1.0 |
| 8 | 0.1% ascorbic acid; oven-dried (60° C., 20 min.) | 65.4 | 1.6 |
| 9 | 2.0% ascorbic acid; oven-dried (60° C., 20 min.) | 65.8 | 2.0 |

These results show that oven drying does retain more of the bleached brightness than air drying and that ascorbic acid treatment is beneficial for oven drying.

EXAMPLES 10–16

A southern pine pulp was bleached in a bleach reactor with 1% V-BRITE B®. Handsheets were made from the bleached pulp and air-dried as shown in Table 4 for Example 10. Palmitoyl ascorbate (PA) was then added to the bleach reactor in the amounts indicated for Examples 10–16, based on the weight of dried pulp. Handsheets made from this bleached and treated pulp were tested for brightness producing the values shown in Table 5.

TABLE 4

| Example No. | Handsheet Treatment | Brightness | Brightness Gain |
|---|---|---|---|
| 10 | None; air-dried | 63.7 | — |
| 11 | 0.01% PA; air-dried | 64.4 | 0.7 |
| 12 | 0.05% PA; air-dried | 63.9 | 0.2 |
| 13 | 2% PA sprayed on; air-dried | 67.9 | 4.2 |
| 14 | 0% PA in reactor; a. d. | 63.6 | −0.1 |
| 15 | 2% PA in reactor; a. d. | 65.9 | 2.2 |
| 16 | 2% PA in reactor +; a. d. 2% PA sprayed on | 68.6 | 4.9 |

The handsheets of Examples 13 and 16 on which PA had been sprayed had a waxy surface, indicating that dosages lower than 2% were needed as a sheet spray. In general, however, these results indicate that even at low treatment levels, much of the antioxidant activity of PA carries through to sheet formation and further indicate that an antioxidant such as PA is suitable for incorporating in the bleach formulation and especially for spraying onto the sheet.

EXAMPLE 17

The procedure of Example 15 was repeated with the exception that a spruce-fir pulp was employed and the concentration of PA was 1%. The results are shown below and compared to controls.

TABLE 5

| CONDITIONS | BRIGHTNESS (ISO) |
|---|---|
| Unbleached (Control) | 59.0 |
| Bleached (Control) | 64.8 |
| Bleached + PA | 67.5 |

EXAMPLES 18–21

Southern pine pulp was bleached with 1% V-BRITE B® for one hour at 60° C. Duplicate handsheets were then prepared from the bleached pulp. Aqueous solutions of ascorbic acid at the concentrations indicated in Table 6 were then sprayed onto the handsheets which were air-dried at ambient temperature. Average brightness values of the handsheets are given in Table 6.

TABLE 6

| Example No. | Treatment | Brightness | Brightness Gain |
|---|---|---|---|
| 18 | None | 61.9 | — |
| 19 | 0.01% AA | 63.8 | 1.9 |
| 20 | 0.05% AA | 65.0 | 3.1 |
| 21 | 1.25% AA | 66.4 | 4.5 |
| 21a | Vacuum only | 68.7 | 6.8 |

The brightness gains are plotted in the Figure against sprayed amounts of ascorbic acid. It is apparent that ascorbic acid gives almost a 2-point gain over the control at an application level of 0.01% and a brightness gain of about 3 points over the control at an application level of about 0.05%, based on dry pulp. Furthermore, the addition of ascorbic acid brightness at about 1.0 brightness gain per 1.0% by weight of the added ascorbic acid, on a dry pulp basis.

EXAMPLE 22

This example will illustrate that the novel process of this invention is operative with reductive bleaches other than dithionite.

Southern Pine pulp was bleached with either 1% V-BRITE B® 1.6% sodium bisulfite or 2.5% sodium borohydride and the pulp formed into handsheets. The bleaching times for the dithionite was 1 hour and for the bisulfite and borohydride was 2 hours.

The handsheets were subjected to three different treatments in order to provide controls and demonstrate this invention. The handsheets were:

(1) air-dried
(2) vacuum-dried
(3) sprayed with 1% ascorbic acid based on weight of dried pulp, then air-dried.

The results are shown below:

TABLE 7

| CONDITIONS | AIR-DRIED (1) | VACUUM-DRIED (2) | TREATED (3) |
|---|---|---|---|
| Unbleached | 50.4 | 50.5 | 51.8 |
| V-BRITE B ® | 59.6 | 62.1 | 60.9 |
| Sodium bisulfite | 53.3 | 53.7 | 54.3 |
| Sodium borohydride | 56.6 | 59.5 | 59.9 |

EXAMPLE 23

An aqueous solution of V-BRITE B® was added to southern pine wood pulp in the bleach reactor at a 1% level. 6-O-Phenyl-L-ascorbic acid (PAA)

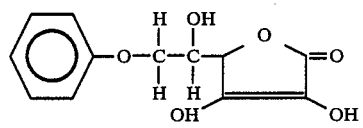

was either added to the reactor or sprayed on the handsheets at a 1 wt. % level based on pulp. Control experiments were also run wherein the handsheets were air-dried or vacuum-dried. Control experiments were also run on unbleached handsheets. The results are shown below:

TABLE 8

| Treatment | Brightness |
|---|---|
| UNBLEACHED | |
| air-dried (no PAA) | 64.80 |
| sprayed with PAA to 1% & air-dried | 65.71 |
| 1% PAA in reactor & air-dried | 65.58 |
| BLEACHED | |
| air-dried (no PAA) | 71.54 |
| vacuum-dried (no PAA) | 73.46 |
| 1% PAA in reactor & air-dried | 71.02 |
| sprayed with PAA to 1% & air-dried | 73.22 |
| sprayed with ascorbic acid & air-dried | 71.02 |

The above results clearly illustrated that the application of a water-soluble antioxidant must take place after substantial dewatering. Thus, when PAA was added to the reactor (before dewatering) no improvement in brightness was detected for the reductively-bleached material. However, when sprayed on the handsheets (which are obviously dewatered), improved results were obtained.

EXAMPLE 24

This example will illustrate that this invention is operative with a peroxide bleach which, like the reductive bleaching processes, retains some potential chromophores.

Southern pine pulp was bleached at 60° C. for 2 hours with 1.77% $H_2O_2$. The bleached pulp was formed into handsheets which were dried and then sprayed as described below, with resultant brightness measured against a $BaSO_4$ standard:

TABLE 9

| Handsheet Treatment | Brightness Run 1 | (% $BaSO_4$) Run 2 |
|---|---|---|
| None, Air Dried | 67.1 | 67.8 |
| None, Vacuum Dried | 67.6 | 69.0 |
| Methanol Sprayed* | 67.7 | 68.4 |
| 1% Ascorbic Acid Sprayed* | 68.8 | 69.1 |
| 1% Palmitoyl Ascorbate Sprayed* | 70.6 | 71.0** |
| 1% Phenyl Ascorbyl Ether Sprayed* | 68.7 | — |
| 0.1% Palmitoyl Ascorbate Sprayed* | — | 68.9 |

*Air Dried (All Values ± 0.1–0.4, Except **, which was ± 0.8)

The 1% palmitoyl ascorbate sheets were waxy, possibly accounting for their large brightness increase. These results indicate that enhanced bleaching is as effective for peroxide-bleached pulps as for reductively bleached pulps.

It is important to note that deionized water and reagent-grade chemicals were used for all of the preceding tests. The effects of metal ions were consequently minimal, and the chelating characteristics of ascorbic acid were irrelevant.

EXAMPLE 25

Southern pine pulp was bleached with 1% V-Brite® B, based on dry pulp by weight, at 3.5% consistency and 60° C. for one hour. Octanoyl ascorbate was either added to the reactor or sprayed on the handsheets at 1 wt. % level based on pulp. Control experiments were also run wherein the handsheets were air-dried or vacuum-dried. Control experiments were also run on unbleached handsheets. The results are shown below:

TABLE 10

| TREATMENT | BRIGHTNESS |
|---|---|
| Unbleached: | |
| No Additive, Air Dried (a.d.) | 55.8 |
| No Additive, Vacuum Dried | 56.9 |
| 1% Octanoyl Ascorbate Sprayed (a.d.) | 57.0 |
| 1% Octanoyl Ascorbate in Reactor (a.d.) | 56.9 |
| Bleached: | |
| No Additive, Air Dried | 64.4 |
| No Additive, Vacuum Dried | 66.2 |
| 1% Octanoyl Ascorbate Sprayed (a.d.) | 65.4 |
| 1% Octanoyl Ascorbate in Reactor (a.d.) | 62.5 |

EXAMPLE 26

Southern pine pulp was bleached for one hour at 60° C., 3.5% consistency, and 5.4 pH. Handsheets were then prepared from the bleached pulp and were either air-dried or vacuum-dried before brightness tests were made. Additional handsheets were prepared and tested in the same manner from the same pulp to which 2% palmitoyl ascorbate was added in the reactor before bleaching. The results are shown on Table 11.

TABLE 11

| TREATMENT | BRIGHTNESS |
|---|---|
| No Additive, Air Dried (a.d.) | 63.6 |
| No Additive, Vacuum Dried (v.d.) | 67.3 |
| 2% Palmitoyl Ascorbate in reactor (a.d.) | 65.9 |
| 2% Palmitoyl Ascorbate in reactor (v.d.) | 68.6 |

EXAMPLE 27

Northeastern Spruce/Fir pulp was made into handsheets which were tested for brightness. The same pulp was bleached for one hour at 60° C., 3.5% consistency, and 5.2 pH. Handsheets were then prepared from the bleached pulp and were either air-dried or vacuum-dried before brightness tests were made. Additional handsheets were prepared and tested in the same manner from the same pulp to which 0.5% palmitoyl ascorbate was added in the reactor before bleaching. The results are shown in Table 12.

TABLE 12

| TREATMENT | BRIGHTNESS |
|---|---|
| Unbleached & air-dried | 62.3 |
| Bleached: | |
| No Additive, Air Dried (a.d.) | 69.6 |
| No Additive, Vacuum Dried (v.d.) | 70.1 |
| 0.5% Palmitoyl Ascorbate in reactor (a.d.) | 70.1 |
| 0.5% Palmitoyl Ascorbate in reactor (v.d.) | 68.6 |

What is claimed is:

1. A method for minimizing brightness reversion of bleached high yield wood pulps containing chromophores, comprising the addition of a furanone to said pulps at 0.1% to 5% by weight, based on the weight of dry pulp, to obtain increased retention of brightness gains created by bleaching wherein said bleaching is reductive bleaching or peroxide oxidative bleaching, said furanone being added before, during, or after said bleaching if said furanone is water insoluble or after substantial dewatering of said pulps if said furanone is water soluble, said furanone being selected from the group consisting of compounds having the formula, 3,4-dihydroxy-2(5H)-furanone, and the following structural formula:

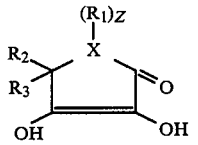

wherein X is O, S, N, Si, C, Z is a whole number from 0–2, $R_1$ is hydrogen or an alkyl having 1–5 carbon atoms, and $R_2$ and/or $R_3$ is any substituent that does not attack the furanone ring.

2. The method of claim 1, wherein said furanone is selected from the group consisting of ascorbic acid, palmitoyl ascorbate, 6-O-phenyl ascorbyl ether, and 6-O-octanoyl-L-ascorbic acid.

3. The method of claim 2, wherein said furanone is added to paper formed from said pulps by spraying a solution of said furanone onto said paper.

4. The method of claim 3, wherein said furanone is ascorbic acid and the addition of said ascorbic acid is beyond about 0.1% by weight of said dry pulp to impart retained brightness at about 1.0 brightness gain per 1.0% by weight of said added ascorbic acid, on a dry pulp basis.

5. The method of claim 1, wherein said pulps are reductively bleached groundwood pulps.

6. The method of claim 5, wherein said bleaching is done with sodium dithionite and wherein said furanone is selected from the group consisting of ascorbic acid, palmitoyl ascorbate, 6-O-phenyl ascorbyl ether, and 6-O-octanoyl-L-ascorbic acid.

7. The method of claim 1, wherein said bleaching is done with sodium dithionite.

8. The method of claim 1, wherein said $R_2$ and $R_3$ are selected from the group consisting of alkyl, substituted alky, aryl, acyl, alkoxy, amino, and quaternary ammonium.

9. The method of claim 1, wherein said X is oxygen and said Z is zero.

10. The method of claim 1, wherein said furanone is selected from the group consisting of compounds having the following substituents:

(A)

X=0

Z=zero $R_3$=H $R_2$=

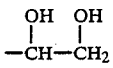

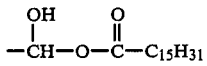

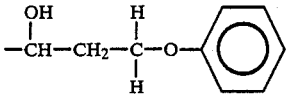

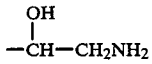

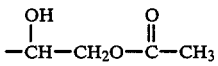

$-NH_2$ $-N(CH_3)_3+$

-continued

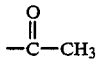

$-O-CH_3$

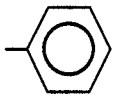

$-CH_3$ (B)

X=S

Z=O $R_3$=H and $R_2$ is defined as in said (A)

(C)

X=C

Z=2

$R_1$=H $R_3$=H and $R_2$ is defined as in said (A)

(D)

X=Si

Z=2

$R_1$=H $R_3$=H and $R_2$ is defined as in said (A)

(E)

X=N $R_1$=H $R_3$=H and $R_2$ is defined as in said (A).

* * * * *